US009159542B2

(12) United States Patent
Mullen et al.

(10) Patent No.: US 9,159,542 B2
(45) Date of Patent: Oct. 13, 2015

(54) APPARATUS AND METHOD FOR INHIBITING IONIZATION SOURCE FILAMENT FAILURE

(75) Inventors: Christopher Mullen, Menlo Park, CA (US); John E. P. Syka, Charlottesville, VA (US); Scott T. Quarmby, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/399,791

(22) Filed: Feb. 17, 2012

(65) Prior Publication Data

US 2013/0214147 A1 Aug. 22, 2013

(51) Int. Cl.

| | |
|---|---|
| ***H01J 49/14*** | (2006.01) |
| ***H01J 49/16*** | (2006.01) |
| ***H01J 27/26*** | (2006.01) |
| *H01J 49/00* | (2006.01) |

(52) U.S. Cl.

CPC ..... *H01J 49/147* (2013.01); *H01J 49/16* (2013.01); *H01J 27/26* (2013.01); *H01J 49/0027* (2013.01); *H01J 2237/06308* (2013.01)

(58) Field of Classification Search

CPC ..... H01J 27/26; H01J 49/16; H01J 15/50; H01J 27/08; H01J 37/08; H01J 2201/19; H01J 2217/062; H01J 2237/06308

USPC ..... 250/288

See application file for complete search history.

(56) References Cited

U.S. PATENT DOCUMENTS

| | | | | |
|---|---|---|---|---|
| 3,509,216 | A * | 4/1970 | Papetti et al. | 568/4 |
| 4,150,558 | A * | 4/1979 | Pohl | 72/370.23 |
| 4,388,560 | A * | 6/1983 | Robinson et al. | 315/111.81 |

(Continued)

FOREIGN PATENT DOCUMENTS

| | | |
|---|---|---|
| WO | WO 2011/028863 A1 | 3/2011 |
| WO | WO 2011/092515 A1 | 8/2011 |

OTHER PUBLICATIONS

Ishizuka et al., "Field Emission Microscopic Observation of the Adsorption of Oxygen, Nitrogen, Hydrogen, Carbon Monoxide and Xenon on Rhenium", J. Res. Inst. Catalysis, Hokkaido Univ., vol. 15, No. 2 (1967).*

(Continued)

*Primary Examiner* — Jack Berman
*Assistant Examiner* — James Choi
(74) *Attorney, Agent, or Firm* — Nicholas Cairns; Thomas F. Cooney; Michael C. Staggs

(57) ABSTRACT

An ion source apparatus for a mass spectrometer comprises a refractory metal filament operable to provide a flow of electrons by thermionic emission; an electrical current source electrically coupled to the filament for heating the filament; a vacuum chamber enclosing the filament; an ionization volume within the vacuum chamber capable of receiving the flow of electrons; a source of an oxygen-providing gas or gases; a restrictive fluidic coupling to the source of oxygen-providing gas or gases; and a gas conduit fluidically coupled to the restrictive fluidic coupling, the restrictive fluidic coupling and conduit operable to provide a flow of the oxygen-providing gas or gases into the vacuum chamber so as to maintain a partial pressure of said gas or gases within the vacuum chamber that is sufficiently high so as to inhibit the otherwise formation of a carbonaceous growth on the filament in the presence of a gaseous carbon-containing material.

26 Claims, 8 Drawing Sheets

(56) References Cited

U.S. PATENT DOCUMENTS

| | | | | |
|---|---|---|---|---|
| 5,313,067 | A * | 5/1994 | Houk et al. | 250/492.21 |
| 5,756,996 | A | 5/1998 | Bier et al. | |
| 7,247,495 | B2 * | 7/2007 | Amirav | 436/173 |
| 7,534,622 | B2 * | 5/2009 | Hunt et al. | 436/173 |
| 7,655,931 | B2 * | 2/2010 | Gupta | 250/492.21 |
| 7,749,769 | B2 | 7/2010 | Hunt et al. | |
| 7,892,690 | B2 * | 2/2011 | Kaye et al. | 429/446 |
| 2005/0225224 | A1 * | 10/2005 | Dally et al. | 313/361.1 |
| 2006/0016978 | A1 * | 1/2006 | McCauley et al. | 250/288 |
| 2006/0097185 | A1 * | 5/2006 | Mack | 250/423 R |
| 2008/0129209 | A1 * | 6/2008 | Deakins et al. | 315/111.91 |
| 2010/0024841 | A1 * | 2/2010 | Koo et al. | 134/1.1 |
| 2010/0140466 | A1 * | 6/2010 | Hartmer | 250/282 |
| 2011/0079241 | A1 * | 4/2011 | Sinha et al. | 134/1.1 |
| 2011/0143451 | A1 * | 6/2011 | Syka et al. | 436/173 |
| 2011/0240848 | A1 * | 10/2011 | Wells | 250/283 |
| 2012/0156792 | A1 * | 6/2012 | Syka et al. | 436/89 |
| 2013/0187058 | A1 * | 7/2013 | Swanson et al. | 250/393 |

OTHER PUBLICATIONS

Wall et al., "Thermionic Work Function of Chemically Vapor Deposited Rhenium on Tungsten", J. Mater. Eng., vol. 11, No. 3 (1989).*

ASTM "Standard Specification for Tunsten—Rhenium Alloy Wire for Electron Devices and Lamps", designation F73-96.*

Gaines et al., "The Behavior of Rhenium in Electron Tube Environments," Journal of the Electrochemical Society, vol. 106, No. 10 (1959), pp. 881-885.

Becker et al., "Reactions of Oxygen with Pure Tungsten and Tungsten Containing Carbon," Journal of Applied Physics, vol. 32, No. 3 (1961), pp. 411-423.

Hamamura et al., "The Reactions between a Rhenium Filament and Oxygen at High Temperatures and Low Pressures," Bulletin of the Chemical Society of Japan, vol. 40 (1967), pp. 1066-1070.

Chao et al., "Work Functions of Rhenium and Tungsten Determined by Thermionic and Mass Spectrometric Measurements," International Journal of Mass Spectrometry and Ion Physics, 12 (1973), pp. 423-432.

Kharkova et al., "Structure of Alloys of the System Rhenium—Carbon in the Region Rich with Rhenium," Institute of Materials Science, Academy of Sciences of the Ukrainian SSR. , Translated from Poroshkovaya Metallurgiya, No. 12(300), pp. 52-56, Dec. 1987. (1986), pp. 994-997.

Vietzke et al., "Chemical Erosion," Physical Processes of the Interaction of Fusion Plasmas with Solids (1996), pp. 135-176.

* cited by examiner

APPARATUS AND METHOD FOR INHIBITING IONIZATION SOURCE FILAMENT FAILURE

CROSS REFERENCE TO RELATED APPLICATION

This application is related to U.S. patent application Ser. No. 12/968,177 filed Dec. 14, 2010 and titled "Method of Operating a Reagent Ion Source", said prior application assigned to the assignee of the instant application and incorporated herein by reference in its entirety.

FIELD OF THE INVENTION

The present invention relates generally to mass spectrometry, and more particularly to ion sources utilized to produce ions in mass spectrometers.

BACKGROUND OF THE INVENTION

Mass spectrometry is widely used in analytical chemistry and other fields for identifying unknown compounds, screening for the presence of certain target compounds, identifying the products of chemical reactions, studying the kinetics or mechanisms of chemical reactions, etc. Since mass spectrometers are capable of directly detecting only ions, provision must be made for ionizing the molecular constituents of samples to be analyzed. Many different types of ion sources are available for this purpose. Various of these ion sources include thermionic cathode filaments for initiating the ionization process. An electric current (either AC or DC) is passed through the filament, which typically comprises a straight, bent or coiled wire or metal foil or ribbon. Through internal electrical resistance, the filament temperature is caused to increase and, in operation, at least a portion of the filament will become sufficiently hot such that electrons are emitted from that portion. If the filament is configured as the cathode member of a cathode/anode pair, the emitted electrons can be accelerated and directed as a beam into an ionization volume within which they may react with various gaseous molecules so as to form ionized chemical species. The electrons emitted from the filament (emission current range 5-500 μA, most commonly 50 μA) are accelerated to kinetic energies of 20 to 150 eV (typically 70 eV) which is generally optimal for ionizing and fragmenting molecules.

Thermionic cathode filaments, as described above, are used in electron ionization (EI) ion sources (referred to as "electron impact" ion sources in some literature), in chemical ionization (CI) ion sources, in ion sources used to produce reagent ions for electron transfer dissociation (ETD) ion-ion reactions and in ion sources used to produce reagent ions for proton transfer reaction (PTR) ion-ion reactions. In the course of operation, various gases are introduced into or are present in such ion sources. These include various "background" gases which, according to the terminology used in this document, are gases that are introduced or are present at moderately high pressures (0.1-2.0 Torr). Such background gases thus include methane ($CH_4$), nitrogen ($N_2$) isobutane ($C_4H_{10}$) and ammonia ($NH_3$). It should be noted that this terminology is slightly different from that usually employed in chemical ionization literature, in which methane, isobutane and ammonia are usually referred to as "reagent" gases. As used in this document, the term "reagent", as applied to gases, is restricted to those gases that are employed as precursors for formation of reagent ions that are employed in ion sources used to produce reagent ions for ETD or PTR ion-ion reactions. Such reagent gases are introduced at low pressures—less than approximately $1\times10^{-5}$ Torr. Additionally, sample gases are introduced into EI and CI ion sources. Sample gases generally include analyte compounds as well as matrix compounds.

In electron ionization (EI) ion sources, the electrons emitted from the thermionic filament are caused to directly impinge upon gaseous molecules of one or more chemical constituents of a sample under investigation. These chemical constituents may include one or more analyte compounds or matrix compounds derived from the sample. The interaction of energetic electrons of the electron beam with an electron cloud of a neutral molecule may effectively "dislodge" one or more electrons of the neutral molecule and may additionally cleave chemical bonds. This combination of ionization and fragmentation may lead to the formation of one or more cation species. It is these cation species that are analyzed by a mass analyzer. Such electron ionization sources are commonly employed in gas chromatography/mass spectrometry (GCMS) instruments.

In chemical ionization (CI) ion sources, a beam of accelerated electrons emitted from a thermionic filament is caused to interact with a low-molecular-weight (less than approximately 50 Da) background gas such as methane, nitrogen, iso-butane or ammonia supplied in relatively high abundance in comparison to the sample molecules. The interaction between such background gas and the introduced electrons may include a complex set of primary and secondary electron-molecule and ion-molecule reactions so as to form a variety of molecular and ionic species. These reactions may also result in a population of near-thermal-energy electrons. The ions formed from the background gas may include species such as $CH_3^+$, $CH_4^{+\bullet}$, $CH_5^+$ and $C_2H_5^+$ (in the case of methane background gas); iso-$C_4H_{10}^{+\bullet}$ and iso-$C_4H_9^+$ (in the case of iso-butane background gas); and $NH_3^{+\bullet}$, $NH_4^+$ and $N_2H_7^+$ (in the case of ammonia background gas). Analyte ions—generally cations—may be created by reaction between analyte molecules and one or more of the ionic species derived from the background gas. In the case of electronegative analyte molecules, electron capture of near-thermal-energy electrons produced upon electron ionization of background gas by the accelerated electrons can yield analyte anions.

In some types of applications, a CI-type source may be employed so as to produce reagent ions for the purpose of conducting ion-ion reactions within a separate ion-ion reaction cell or region of a mass spectrometer apparatus. The reagent ions are derived from a reagent precursor material that is introduced in gas form into an ionization volume of the CI-type source. After generation, the reagent ions are subsequently transferred to and employed in a reaction cell where they are caused to react with sample-derived precursor ions so as to induce dissociation or charge reduction of the precursor ions. The diagnostic ions are thus, in this case, product ions that are formed by reaction between the reagent ions and the sample-derived precursor ions in the ion-ion reaction cell, chamber or region. In such applications, the sample constituents are initially ionized using another separate ion source of the mass spectrometer apparatus. The mass spectrometer apparatus will thus include two ion sources—a first ion source (typically an electrospray ionization source) for initially ionizing the sample-derived materials and a second CI-type source, here referred to as a reagent ion source, for generating reagent ions.

Electron transfer dissociation (ETD) is a first type of application that employs a reagent ion source—in this case, an ETD source. The ETD technique is described by Hunt et al. in U.S. Pat. No. 7,534,622 for "Electron Transfer Dissociation for Biopolymer Sequence Mass Spectrometric Analysis", by Syka et al. in "Peptide and Protein Sequence Analysis by Electron Transfer Dissociation Mass Spectrometry", *Proc. Nat. Acad. Sci.*, vol. 101, no. 26, pp. 9528-9533 (2004), by Coon et al. in "Anion Dependence in the Partitioning Between Proton and Electron Transfer in Ion/Ion Reactions", *Int. J. Mass Spectrometry*, vol. 236, nos. 1-3, pp. 33-42 (2004), by Syka et al. in International Application Publication WO 2011/028863 A1, by Hartmer in U.S. Patent Application Publication No. 20100140466 A1 and by Brown et al. in International Application Publication WO 2011/092515 A1, all of which are incorporated herein by reference. Proton transfer reaction (PTR) is a second type of application that employs a reagent ion source (in this case, a PTR source). The PTR technique is described by Hunt et al. in U.S. Pat. No. 7,749,769 for "Simultaneous Sequence Analysis of Amino- and Carboxy-Termini" as well as in Stephenson and McLuckey, *Anal. Chem.* 1996, 68, pp. 4026-4032 and McLuckey and Stephenson, *Mass Spectrometry Reviews* 1998, 17, pp. 369-407.

In either the ETD or the PTR technique, near-thermal-kinetic-energy electrons produced during electron ionization of a background gas such as nitrogen are captured, in an ETD or PTR ion source, by molecules of a reagent gas so as to produce reagent anions. The reagent anions are then transferred out of the ion source and into a reaction cell in which they are allowed to react with ions of an analyte.

In the ETD technique, the anions are reacted with multiply charged analyte cations (for example, multiply protonated peptide/protein molecules) so as to transfer an electron from the reagent anion to the analyte cation, thereby inducing dissociation of the analyte cation. As discussed in U.S. Pat. No. 7,534,622, many gaseous polycyclic aromatic hydrocarbon species (also known as "polyaromatic hydrocarbon" species) may be suitably employed as ETD reagents (reagent-ion precursors). These include but are not necessarily limited to the compounds naphthalene; fluorine; phenanthrene; pyrene; fluoranthene; chrysene; triphenylene; perylene; acridine; 2,2' dipyridyl; 2,2' biquinoline; 9-anthracenecarbonitrile; dibenzothiophene; 1,10'-phenanthroline; 9' anthracenecarbonitrile; anthraquinone and substituted derivatives of these compounds.

Recently, Syka et al. (International Application Publication WO 2011/028863 A1) have taught the use of certain additional polycyclic aromatic hydrocarbon species as ETD reagents. These new ETD reagent compounds include azulene, homoazulene, acenaphthylene, homodimers of any of azulene, homoazulene, or acenaphthylene and heterodimers comprising one each of azulene, homoazulene, or acenaphthylene. Additionally, Brown et al. (International Application Publication WO 2011/092515 A1) have recently taught the use, as ETD reagents, of certain unsaturated organic compounds having respective Franck-Condon factors between 0.1 and 1.0 and positive electron affinity (EA) values of between 0.1 to 200 kJ/mol. As is known, the Franck-Condon factor is a measure of the overlap of the vibrational wavefunctions of neutral and anionic species. The ETD reagents taught by Brown et al. include the aromatic (not polycyclic aromatic) compounds nitrosobenzene; nitrobenzene; 1,4 dicyanobenzene; 1,3 dicyanobenzene; 5-cyano 1,2,4-triazole; amitrole 2-aminopyridine; 2-pyridine carbonitrile; 3-pyridine carbonitrile; 3-chlorobenzonitrile; 4-chlorobenzonitrile; 3-pyridinecarbonitrile; and 4-pyridinecarbonitrile. The ETD reagents taught by Brown et al. further include the non-aromatic compounds 1,2-dicyanoethylene and 1,2-dicyanoacetylene.

Still further, Hartmer (U.S. Patent Application Publication No. 20100140466 A1) has recently taught that certain aliphatic compounds having electron affinity values between 0.3 and 0.8 electron-volts may also be employed as ETD reagents (reagent-ion precursor gases). Hartmer notes that certain aliphatic compounds having double bonds, particularly polyenes, are especially favorable in this regard. Hartmer further notes that the compound un-substituted 1,3,5,7-cyclooctatetraene ($C_8H_8$) is an aliphatic polyene that is a particularly favorable compound for use as a reagent-ion precursor gas for ETD. Hartmer further notes that some forms of 1,3,5,7-cyclooctatetraene obtained through alkyl substitution (alkyl=methyl, ethyl, propyl, isobutyl), and some forms of cyclooctatetraene with heteroatoms are also suitable for the creation of ETD reagent ions.

In the PTR technique, multiply charged analyte cations (for example, peptide/protein cations) are reacted with an anion that removes protons from the analyte cation, thereby reducing the net charge of the analyte cation without causing fragmentation. In this fashion, the charge state of the ion can be determined. Benzoic acid ($C_6H_5COOH$) is commonly used as a reagent for PTR and has been observed to promote growth of carbonaceous masses on thermionic filaments. As discussed in U.S. Pat. No. 7,749,769, other suitable PTR reagents include, but are not limited to, perfluoro-1,3-dimethylcyclohexane, sulfur hexafluoride, and perfluorotributylamine.

In general, relatively modest flows (typically on the order of 0.2 to 5 atm-mL/minute) of low molecular weight background gases (approximately less than 50 Da), such as those listed above, can pressurize the ionization region of a CI-type source to about 0.1 to 2 Torr. The electron stream emanating from the filament is directed into the interior of an ionization volume into which the high abundance background gas is admitted. If the CI-type source is used to ionize sample-derived compounds, molecules of the sample material are also admitted into the ionization volume in the gas phase. In this case, ions formed from the background gas react with the sample or analyte molecules so as to yield sample ions.

In ETD or PTR reagent ion sources, molecules of the reagent precursor gas (but not sample-derived compounds) are introduced into the ionization volume in the gas phase. The reagent precursor gas may typically comprise an aromatic or poly-aromatic compound but is not limited to these classes of chemical compounds. In the ionization volume, near-thermal electrons are captured by the reagent molecules (i.e., via electron capture ionization) to produce reagent anions, which are then conveyed to the appropriate reaction cell of a mass spectrometer for reaction with analyte ions. In this ETD-type or PTR-type of application, typical background or reagent gas (typically nitrogen or methane) pressures for achieving maximum reagent ion generation are typically in the range of 0.1 to 0.4 Torr.

Each of the ion-source types described above typically employs a thermionic filament to generate the electron beam that initiates ionization. Because a gas diffusion or gas flow pathway will generally exist between the hot, electron-emitting portion of the filament and the gas or gases that are to be ionized, it is not possible to fully shield this filament portion from coming into contact with possible contaminating molecules or ions. Exposure to some of these gases can have a deleterious effect on the structural integrity and lifetime of a filament. Such filament-compromising gas species may be derived from a sample component such as an analyte or matrix compound (in the case of EI sources or CI sources used to ionize analytes), from a reagent gas (in the case of ETD or PTR reagent ion sources) or a carbon-containing background gas. The element carbon is the most abundant element of many of such sample or reagent materials. Unfortunately, the solubility of carbon in common filament materials is non-negligible in the temperature range (at or above approximately 1200 K, but typically 2200-2700 K) necessary to achieve suitable electron beam currents for the above-described ion sources.

In accordance with the above considerations, it has been observed that when a filament-based ion source is employed in the various manners described above to generate ions, its filament may exhibit the formation of a carbonaceous growth adjacent to one or both terminating poles, resulting in the eventual failure of the filament. Such carbonaceous masses are herein referred to as "tumors". Without reliance on any particular theory, it is believed that carbonaceous growth formation arises from the diffusion and/or electromigration of dissolved carbon in the filament. As the carbon reaches the cooler portion of the negative leg (using a direct-current source) or either leg (using an alternating-current source) of the filament, it is believed that its electromobility through and solubility within the metal filament drops and, consequently, the carbon precipitates from solution and accumulates. The precipitation of the carbon-bearing phase or phases disrupts the structural integrity of the metal filament, ultimately causing its failure.

The primary source of the dissolved carbon has been experimentally demonstrated to be the sample, sample matrix or reagent molecules that diffuse to and react with the filament. The applicants believe that these carbon-containing molecules decompose upon contact with the filament when the filament is heated to the temperatures necessary to promote electron emission and the resultant carbon atoms diffuse into the bulk filament material. It has been found that such carbonaceous tumor growth can occur on filaments within electron ionization (EI) and CI ion sources, which are most commonly employed in gas chromatography mass spectrometry (GC-MS) applications. In such cases, a carbon-containing sample material, analyte and/or matrix, is believed to be the source of the carbon that causes the tumor growth.

The growth of carbonaceous tumors on ion-source filaments is believed by the inventors to be a general phenomenon that occurs when such filaments are exposed to almost any carbon-containing gas or gases. The inventors have observed such carbonaceous tumor growth on filaments exposed to the ETD reagent gases fluoranthene and phenanthrene, to the PTR reagent gas benzoic acid, to the common calibration gas perfluorotributylamine, as well as to, in EI applications, matrix compounds in gases derived from various silicone samples and food samples. Although carbon containing background or reagent gases have the potential to deliver carbon to filaments, in the inventors' experience, methane, the most widely used background gas for CI applications, does not induce the growth of carbonaceous tumors on filaments. However, many other background or reagent gases are likely to do so.

The above-described "tumor growth" failure mode is distinguishable from the "normal" filament failure mode, caused by the gradual sublimation of the filament material (e.g., rhenium) at hottest point on the filament where the majority of the electron emission occurs (e.g., proximate to the tip or apex of the filament for hair pin type filaments). The occurrence of carbonaceous growth formation has a strong likelihood of significantly shortening the filament lifetime, thereby increasing instrument downtime due to the need to replace the filament at relatively frequent intervals. The problem of carbonaceous growth formation and consequent filament failure is exacerbated by the conditions at which the CI-type source is typically operated for generating reagent ions (such as PTR and ETD reagent ions) for ion-ion reaction applications. More specifically, the source is operated as a "bright" (relatively high ion production rate, usually in excess of $3\times10^7$ reagent ions/second) reagent ion source to minimize the time required to generate the requisite numbers of reagent ions, thereby enabling relatively high numbers of ETD MS/MS experiments to be conducted in a given time. Furthermore, in the context of large-scale proteomics studies, the source may be operated on a near-continuous basis over multiple days. The foregoing and other factors may tend to promote and accelerate the processes that produce carbonaceous growth formation.

SUMMARY

In a first aspect, there is disclosed a method for operating an ion source for a mass spectrometer having a refractory metal thermionic filament, the method comprising: (a) providing a vacuum within which the filament is disposed; (b) providing a source of an oxygen-providing gas or gases; and (c) providing a controlled flow of gas from the source of oxygen-providing gas or gases into the vacuum chamber so as to maintain a partial pressure of oxygen or other oxygen-containing gas or gases in the vicinity of the filament that is sufficiently high so as to inhibit the formation of a carbonaceous growth on the filament in the presence of a carbon-containing material. In accordance with some embodiments, the ion source may comprise an electron ionization (EI) source and a sample (analytes and matrix) provided to the mass spectrometer may comprise the carbon-containing material. In accordance with various other embodiments, the method may further comprise (d) providing a conduit operable to provide a reagent gas into the ionization volume so as to maintain a partial pressure of the reagent gas of at least $1\times10^{-7}$ Torr, and wherein the reagent gas comprises the carbon-containing material. In some embodiments, the maximum flow rate of the controlled flow of gas may be limited such that the partial pressure of oxygen or oxygen-providing gas or gases within the vacuum chamber is insufficient to promote significant evaporation of the refractory metal from the filament.

In another aspect, there is provided an ion source apparatus for a mass spectrometer comprising: a refractory metal filament operable to provide a flow of electrons by thermionic emission; an electrical current source electrically coupled to the filament for heating the filament to induce thermionic emission of electrons from said filament; a vacuum chamber enclosing the filament; an ionization volume within the vacuum chamber capable of receiving the flow of electrons; a source of an oxygen-providing gas or gases; and restrictive fluidic coupling to or between the vacuum chamber and the source of oxygen-providing gas or gases, wherein the restrictive fluidic coupling and (or) associated gas conduits is (are) operable so as to maintain a partial pressure of oxygen or oxygen-providing gas or gases within the vacuum chamber that is sufficiently high so as to inhibit the formation of a carbonaceous growth on the filament in the presence of a gaseous carbon-containing material which may comprise a carbon-containing compound from a sample, a reagent gas or a background gas. In various embodiments, the ion source may comprise an electron ionization (EI) source and a sample provided to the mass spectrometer may comprise the carbon-containing material. In various other embodiments, the ion source may comprise a chemical ionization (CI) source, an electron transfer dissociation (ETD) or a proton transfer reaction (PTR) source and a supplied background or reagent gas may comprise the gaseous carbon-containing material. The apparatus may further comprise a conduit operable to provide the background or reagent gas into the ionization volume. In various embodiments, the reagent gas is an ETD or PTR precursor reagent gas and the reagent gas conduit is operable so as to maintain a partial pressure of the reagent gas of at least $1\times10^{-7}$ Torr within the ionization volume.

In various embodiments, the restrictive fluidic coupling may comprise a metering valve or variable leak rate valve. In other embodiments, the restrictive fluidic coupling may comprise an adjustable pressure regulator followed, along the gas flow path, by a gas flow restrictor. The restrictive fluidic coupling could also comprise a mass flow controller. The gas flow restrictor may comprise a capillary restrictor—e.g., a capillary having a chosen narrow bore along all or a part of its length—or, alternatively, a fit or an equivalent gas flow restrictor. Alternatively, the restrictive fluidic coupling may comprise a fixed pressure regulator followed, along the gas flow path, by a capillary restrictor, frit or other equivalent gas flow restrictor. In various embodiments, the source of oxygen-providing gas or gases could comprise ambient air, in which case the restrictive fluidic coupling may comprise just a capillary restrictor, frit or other equivalent gas flow restrictor.

In yet another aspect, there is provided a method for reconditioning a thermionic filament within a vacuum chamber of an ion source of a mass spectrometer, the filament having a carbonaceous mass thereon produced during prior operation of the filament, the method comprising: providing a gaseous source of oxygen or oxygen-providing gas or gases; providing an electric current through the filament so as to heat the filament thereby; and providing a flow of gas from the gaseous source of oxygen or oxygen-providing gas or gases into the vacuum chamber for a sufficient length of time such that the carbonaceous mass disappears.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1-5, in which like reference numbers refer to like elements, in conjunction with the following discussion.

Figure 1A:
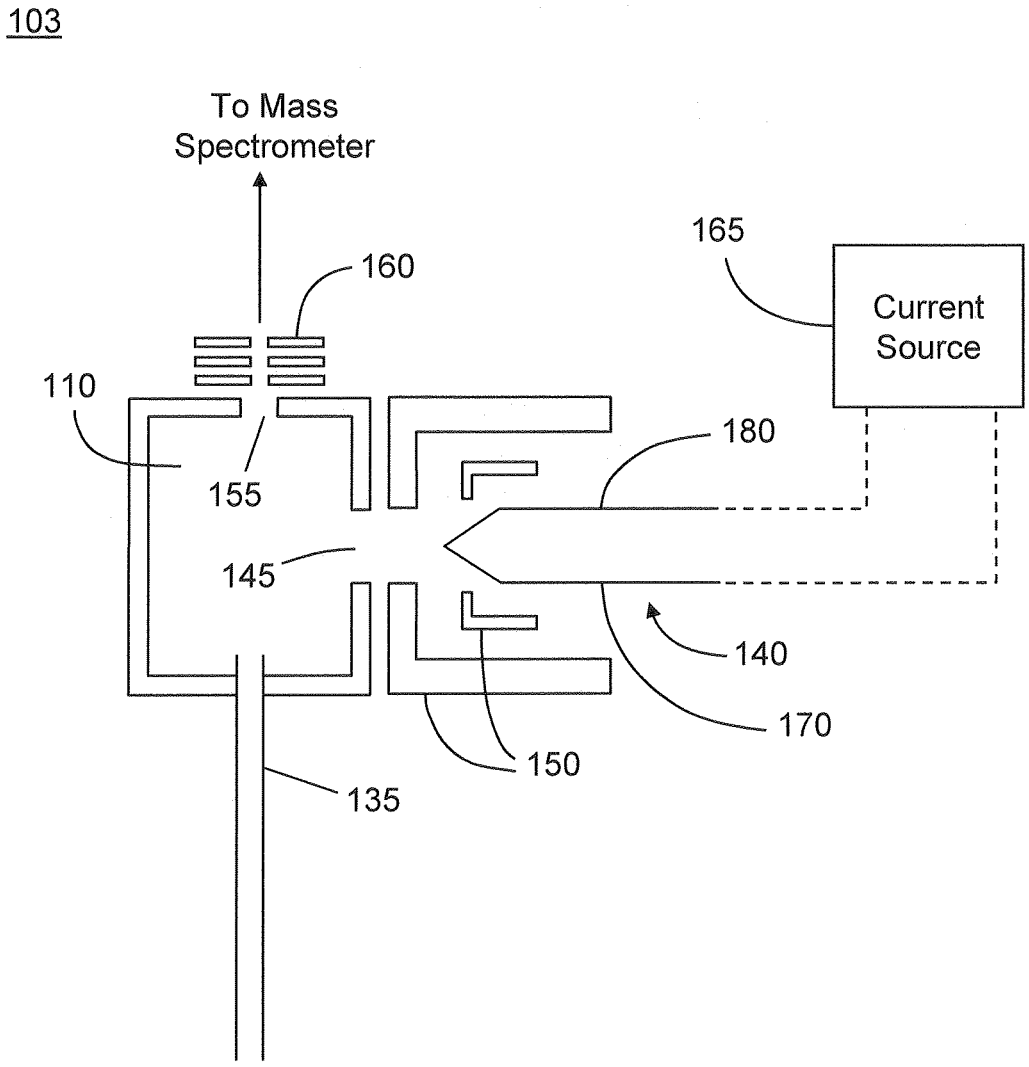
FIG. 1A (Prior Art)
FIG. 1A is a symbolic diagram of a conventional electron ionization (EI) ion source.

FIG. 1A is a symbolic diagram of an ion source 103 configured to produce analyte ions by electron ionization (EI). Ion source 103 includes an ionization volume 110 into which sample molecules including analyte molecules are introduced via, for example, an end portion of a gas chromatograph (GC) column 135. The GC column 135 may be a fused silica capillary tube of a type well known in the art. Ionization volume 110 is located inside a vacuum chamber evacuated to a suitable pressure by a not-illustrated pumping system. A stream of electrons is generated by passing a current provided by a filament current source 165 through thermionic filament 140. The filament current source 165 is located externally to the vacuum chamber and electrically connected to the filament 140 via a vacuum feed-through (not shown). Filament 140 is typically fabricated from a refractory metal such as rhenium or tungsten (or alloys thereof). The refractory metal may include a low work function coating such as thorium oxide or yttrium oxide. Electrons emitted by filament 140 travel, under the influence of an electrical field established by applying suitable potentials to the filament 140 and electrodes 150, through aperture 145 into the ionization volume 110 interior. The electron beam may also be guided by a magnetic field established by magnets (not shown) located behind and on the opposite side of ionization volume 110 from filament 140. The electrons interact with the sample molecules within ionization volume 110 to form sample ions. The sample ions are extracted from ionization volume 110 via ion exit aperture 155 by lenses 160, and are transported through an ion guide or other suitable ion optics to a mass analyzer for analysis.

Figure 1B:
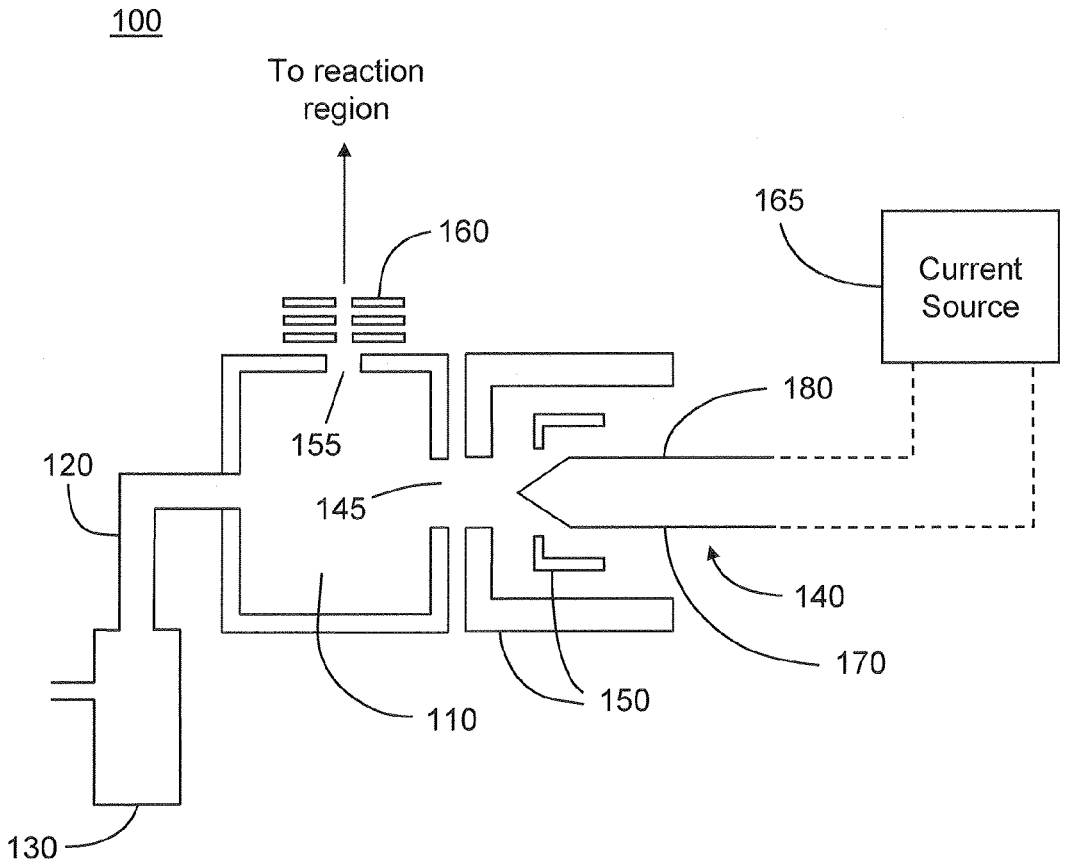
FIG. 1B (Prior Art)
FIG. 1B is a symbolic diagram of an ion source configured to produce reagent ions for use in ion-ion reactions.

FIG. 1B is a symbolic diagram of an ion source 100 configured to produce reagent ions for use in ion-ion reactions within a separate reaction region such as an ion trap or ion guide adapted to serve as an ion-ion reaction cell or chamber. For example, the ion source 100 may be an ETD ion source or a PTR ion source. The ion-ion reagent molecules may be generated by controllably heating a vial 130 containing a quantity of the reagent substance in condensed phase form. The reagent substance may comprise any suitable ETD reagent or PTR reagent and, possibly, mixtures thereof. Several suitable ETD and PTR reagent compounds are provided in the list and references noted above as well as in PCT Application No. PCT/US2010/047620, which is also incorporated by reference. A flow of a carrier gas transports the reagent molecules from the headspace of vial 130 to the interior of ionization volume 110 via a fluidic coupling or conduit 120 which may comprise a narrow bore tubing, a frit or a capillary. The amount of reagent gas molecules delivered to the source can be controlled by the choice or adjustment of the carrier gas flow and the vial temperature or some combination thereof.

Figure 1C:
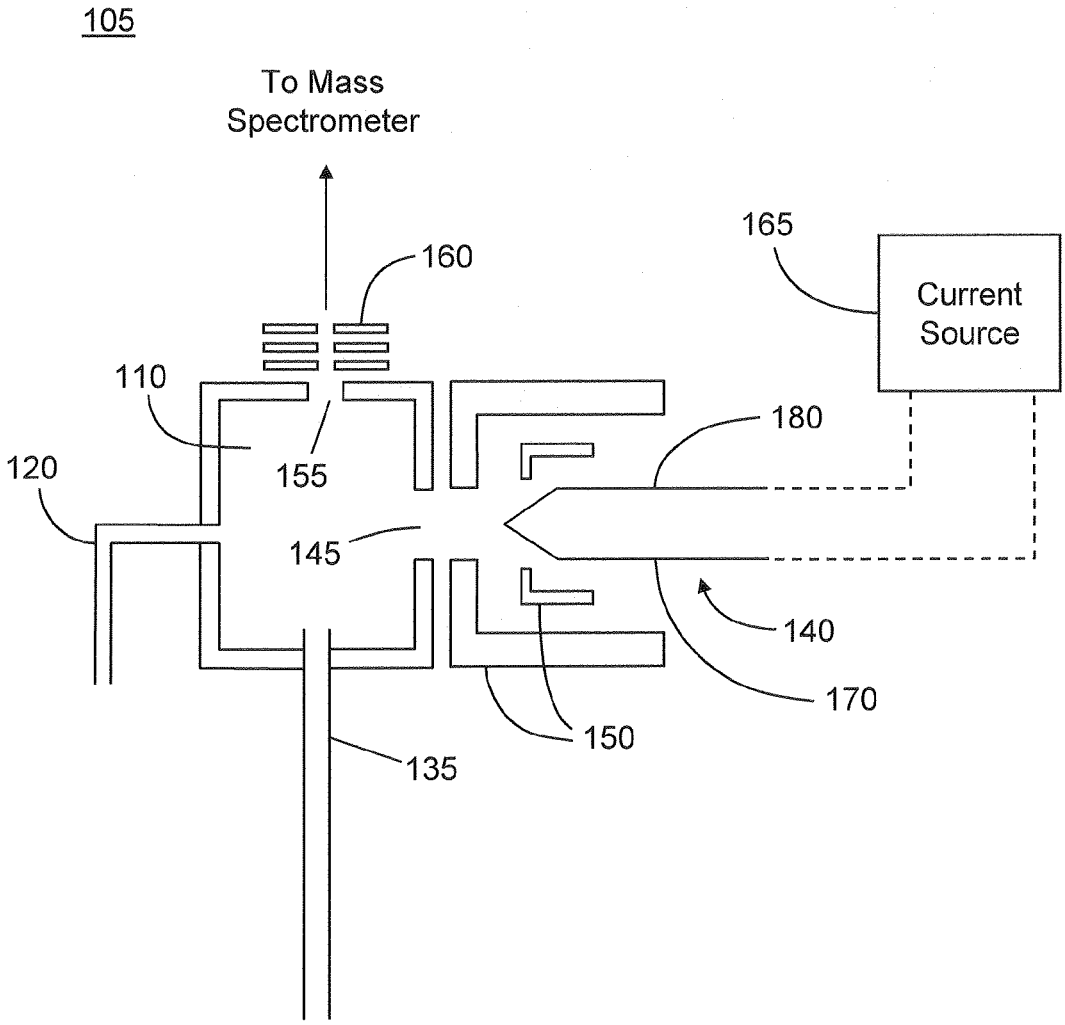
FIG. 1C (Prior Art)
FIG. 1C is a symbolic diagram of a chemical ionization (CI) source for a mass spectrometry system.

FIG. 1C is a symbolic diagram of a CI ion source 105 as may be used in a GC-MS system. The ion source 105 comprises two inlets for introduction of gaseous molecules into the ionization volume 110. A first such inlet is the conduit 120 which provides background gas molecules as in the ion source 100 (see FIG. 1B). The other inlet to the ionization volume 110 is an end portion of a gas chromatograph (GC) column 135. For example, the GC column 135 may be a fused silica capillary tube of a type well known in the art. The background gas utilized in a GC-MS system may exist in a naturally gaseous state so that a condensed phase background chemical containing vial may not be required. Other components illustrated in FIG. 1C are similar to those shown in FIGS. 1A-1B.

Figure 2:
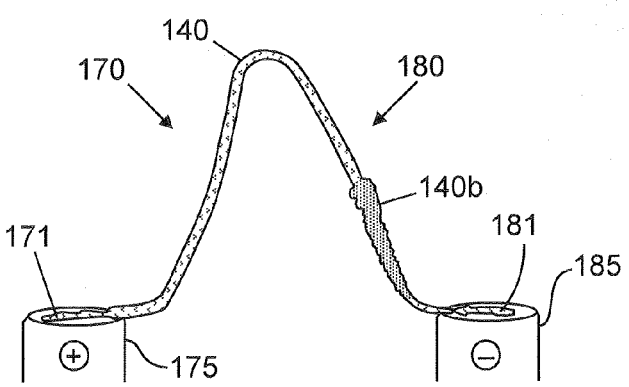
FIG. 2 is a drawing reproduced from a photograph of a filament from an electron transfer dissociation (ETD) ion source damaged by tumor growth.

As discussed above, the exposure of an operating thermionic filament 140 to the vapor phase carbon-containing molecules from a reagent, background or sample-derived gas may cause carbonaceous growth formation via migration of dissolved carbon to the cooler portion of the filament 140 and its consequent precipitation. FIG. 2 is a drawing reproduced from a photograph of a filament 140 from a commercially produced ETD reagent ion source (Thermo Fisher Scientific) degraded in this fashion. In this instance, the filament 140 comprises a bent metal wire or strip—typically fabricated from rhenium or some alloy of rhenium—that is soldered or welded to a positive terminal 175 at a first end and to a negative terminal 185 at a second end. The existence of the bend or apex in the filament gives rise to hairpin or "V" or "U" shape that comprises a first filament leg 170 having an end 171 that is soldered or welded to the positive terminal 175 and a second filament leg 180 having an end 181 that is soldered or welded to the negative terminal 185. The positive and negative terminals are electrically connected to an electrical current source 165 (FIGS. 1A, 1B) so as to supply a current through the filament so as to heat the filament to cause thermionic emission. As typically observed by the inventors, a carbonaceous mass 140*b* forms on the negative polarity leg 180 of such a filament when a DC filament current source is used, as was the case for the filament shown in FIG. 2. Carbonaceous masses typically form on both legs when an AC filament current source is used. Similar carbonaceous tumors have been observed to also form on straight (not bent) rhenium and rhenium alloy filaments as well as on tungsten filaments. Similar tumor growth is expected on ribbon (rectangular cross section) filaments as well as coiled filaments. The growth rates of carbonaceous masses on AC powered filaments are observed to be approximately one-half (or less) of the growth rates on correspondingly operated DC powered filaments. The carbonaceous mass 140*b* may be visually apparent in an ETD ion source within 1-2 days after commencement of continuous use of the filament. Such a carbonaceous mass may continue to grow thicker and towards the filament apex with continued filament operation thereafter. Typically, a filament having such a growth as shown in FIG. 2 will fail by breakage of the filament either within the carbonaceous mass 140*b* or near the juncture of the carbonaceous mass 140*b* with the clean metal portion of the filament.

Figure 3:
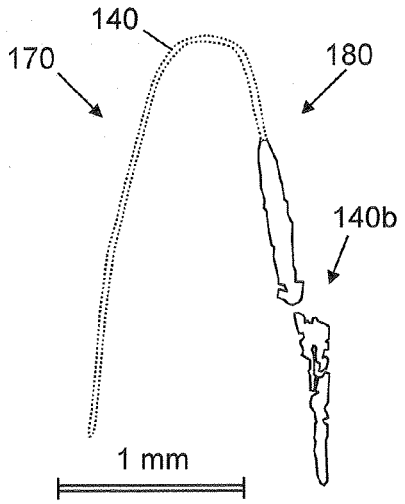
FIG. 3 is a drawing reproduced from a reflected-light photomicrograph of a polished section of a broken and failed rhenium filament from an ETD ion source.
Figure 4:
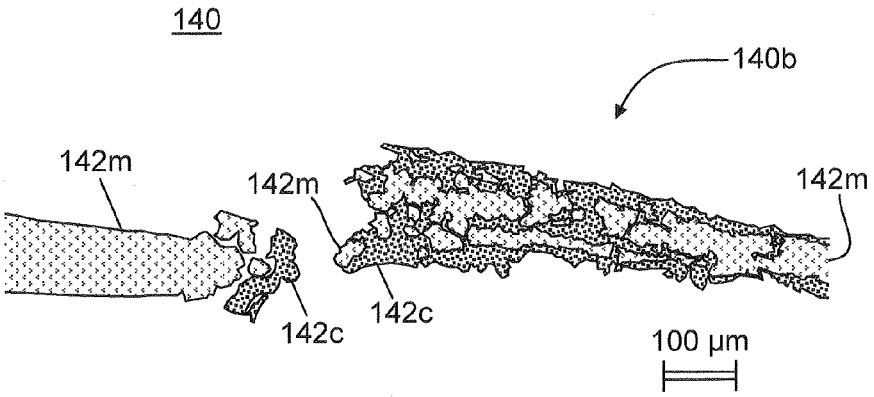
FIG. 4 is a drawing reproduced from a reflected-light photomicrograph of a portion of the filament shown in FIG. 3.

FIG. 3 is a drawing reproduced from a photomicrograph of a polished section of a broken and failed rhenium filament 140 which had been operated with a DC current while exposed to vapor phase fluoranthene. As illustrated, the polished section is mounted in epoxy and viewed in reflected light. The dotted-line portion of the filament 140 shown in FIG. 3—including the positive leg 170 and a portion of the negative leg 180—resides "submerged" within the transparent epoxy below the polished surface. The apparent narrowness of this submerged portion of the filament is an artifact of the reflected-light photomicrograph process, since only the topmost surface of the rounded wire filament is able to back-reflect light into the microscope objective. The portion of the filament 140 indicated in solid lines—including a cross section through the clean metal portion of the negative leg 180 as well as through the carbonaceous mass 140*b*—resides at the polished surface of the sample mount. FIG. 4 is a magnified portion of the filament 140 shown in FIG. 3, showing breakage of the filament at the approximate position of the juncture of the carbonaceous mass 140*b* with the clean rhenium portion. In the magnified view, the carbonaceous mass 140*b* is seen to consist of an over-coating of a carbon-bearing material 142*c*—such as graphite, a fullerene, one or more metal carbides or metal-carbon alloys or some mixture thereof—surrounding a disrupted core of residual rhenium metal 142*m* that is partially penetrated by the carbon-bearing phase or phases.

For the particular case of an ETD ion source operating with aliphatic, aromatic or poly-aromatic hydrocarbon (PAH) reagents, the tumor formation process is speculated to involve transport of gas-phase carbon containing species to the surface of the filament (Re), decomposition of these gas-phase species at the highest temperature portions of the filament, incorporation of elemental carbon resulting from the decomposition into the filament, current-mediated migration of the incorporated carbon to a lower-temperature region of the filament; and, finally, separation of the carbon as a new solid phase. In the case of rhenium filaments, although it is well known that rhenium metal does not form a stable carbide compound, the rhenium-carbon system does support a number of alloys of different phases and possibly an unstable intermediate compound (Khar'kova and Velikanova, Powder Metallurgy and Metal Ceramics, vol. 26, no. 12, 1987, pp 994-997), some of which tend to segregate carbon. Such alloys can form provided that the temperature of the filament is great enough to permit dissolution of carbon within the metal. Additionally, carbon is known to diffuse rather rapidly through rhenium. Therefore, when the surface of the filament has access to a carbon-bearing chemical component, which is provided by the reagent gas, it can incorporate a portion of the carbon into the filament as a solid solution. The dissolved carbon is then caused to migrate, within the relatively hotter portions of the filament, likely under the motivation of the electric field within the wire. This forced migration process ends when the carbon migrates into a lower-temperature leg of the filament, such as near an electrical terminal, where the carbon mobility and solubility within the bulk filament material is lower. The carbon thus exsolves from solution in the wire forming both the carbonaceous mass and the loss of metal filament structural integrity.

Experiments have demonstrated that the tumor location is dependent on the direction of the current in the filament (in the case of a DC current source) and the filament temperature, while the rate of growth is best correlated to the abundance of reagent vapor molecules within ionization volume 110 (FIG. 1B), which in turn affects the number of reagent vapor molecules that pass through aperture 145 and contact the filament 140. During typical operation, the ionization volume 110 is filled with the reagent vapor to a partial pressure of at least $1\times10^{-7}$ Torr, and preferably at least $3\times10^{-7}$ Torr (and in certain preferred implementations at least $1\times10^{-6}$ Torr). Although the rate of carbonaceous growth formation could be reduced by operating the CI source at a lower reagent partial pressure, doing so is undesirable as it would decrease the production of reagent ions, resulting in lower reaction rates and thus, longer reaction times and/or lengthened reagent ion fill times to achieve an equivalently complete ion-ion reaction and would thus result in an overall longer analysis cycle time.

The inventors have determined that formation of carbonaceous masses and consequent filament failure may be prevented or inhibited and even reversed by exposure of the filament to a suitable partial pressure of an oxidizing gas (e.g., $O_2$ at approximately $10^{-6}$ Torr). The inventors believe $N_2O$, $H_2O$ or other oxygen-bearing compounds would also likely serve similarly as $O_2$ in the prevention or inhibition or reversal of the growth of such carbonaceous masses. The underlying mechanism is speculated to involve the reaction of oxygen-bearing compounds with the carbonaceous material being deposited on the filament, resulting in the formation of CO, and $CO_2$. It is thought that the high-temperature environment of the filament while it is in operation would facilitate such processes. The inventors hypothesize that oxygen reacts with the carbon on the filament surface and, if the oxygen or oxygen bearing oxidizing gas is at a suitably high partial pressure, it removes carbon from the filament in the form of CO and $CO_2$ at a rate that is sufficiently high to at least match the rate of deposition and diffusion of the carbon into the surface of the filament thus inhibiting tumor formation.

Figure 5A:
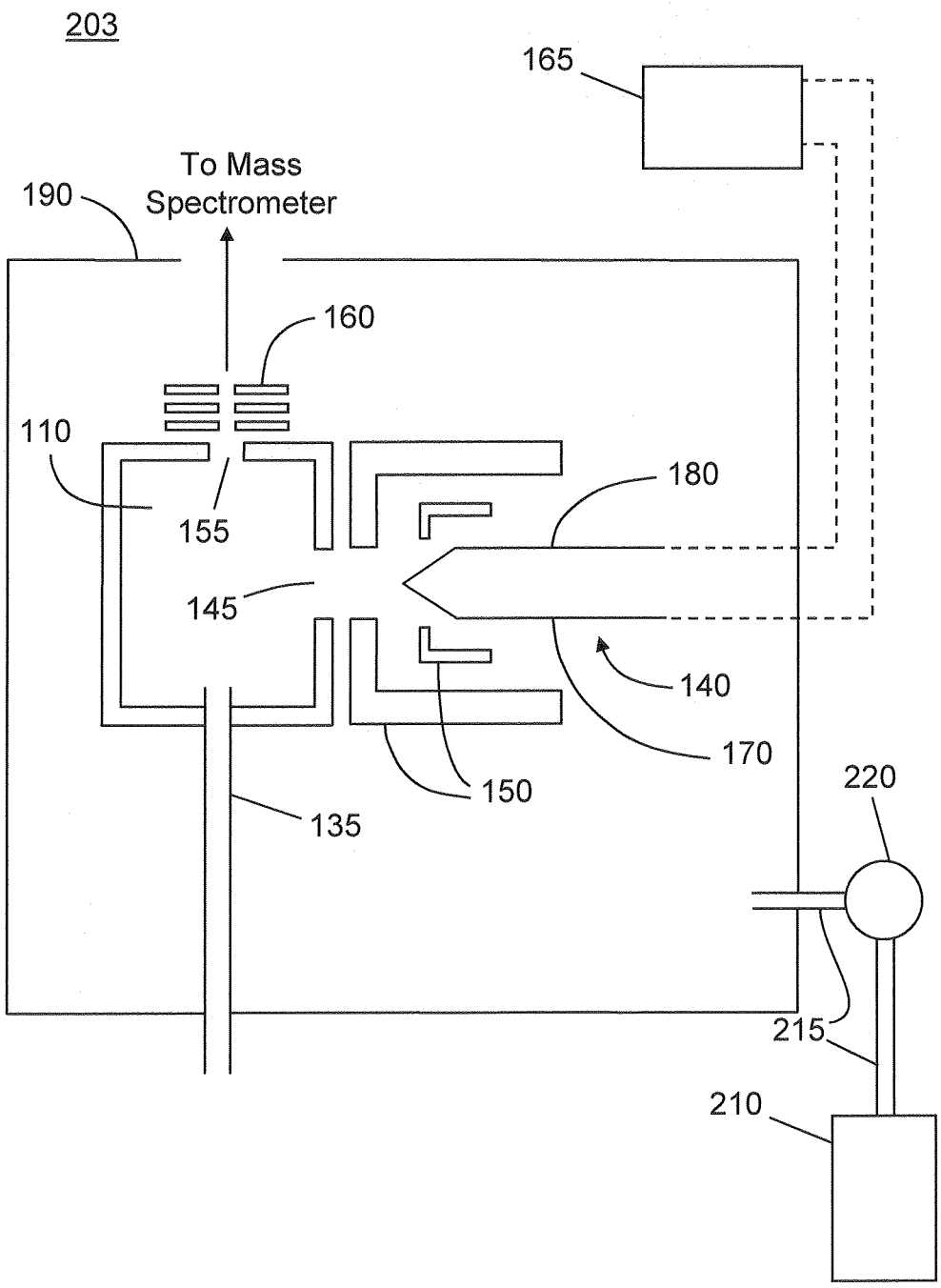
FIG. 5A is a schematic diagram of an EI ion source in accordance with the present teachings.

FIGS. 5A-5D schematically illustrate various examples of ion source apparatuses, in accordance with the present teachings, that facilitate prevention or inhibition of carbonaceous mass growth on metal filaments in the presence of carbon-containing reagent, background, matrix or analyte gases. FIG. 5A provides an example of an EI ion source apparatus 203. In the EI ion source apparatus 203, the filament 140 (comprising legs 170 and 180), an ionization volume 110, electrodes 150, aperture 145, and lenses 160 perform similar functions to comparably numbered components in FIG. 1A. This set of components is maintained within a vacuum chamber 190 that is fluidically coupled to a vacuum system (not shown) that is able to maintain the interior pressure of the chamber at approximately $1\times10^{-6}$ Torr to $1\times10^{-3}$ Torr. The apparatus 203 further comprises an oxygen source 210 such as, for example, a gas cylinder or lecture bottle containing a pressurized gas mixture of x percent oxygen ($O_2$) and (1−x) percent of another gas or of a mixture of other gases, where x ranges from 0.1 to 25 of oxygen or other oxygen-providing gas. Commonly, the other gas may be nitrogen ($N_2$). In the example shown, the oxygen source 210 is fluidically coupled to a variable metering or variable leak rate valve 220 which is, in turn, fluidically coupled to the interior of the vacuum chamber 190 via an auxiliary gas conduit 215. The variable leak rate valve may be operated manually (or, alternatively, automatically) so as to permit a controlled flow of gas from the oxygen source 210 into the interior of the vacuum chamber 190. The oxygen-providing gas or gas mixture could also be pure oxygen, other oxygen-containing gases such as nitrogen oxides, $H_2O$ or even air, such as zero grade air. Zero grade air, sometimes referred to as "zero air" is atmospheric air that has been purified so as to contain less than 0.1 parts per million of total hydrocarbons. Zero grade air provides a safe and widely available source of oxygen.

Figure 5B:
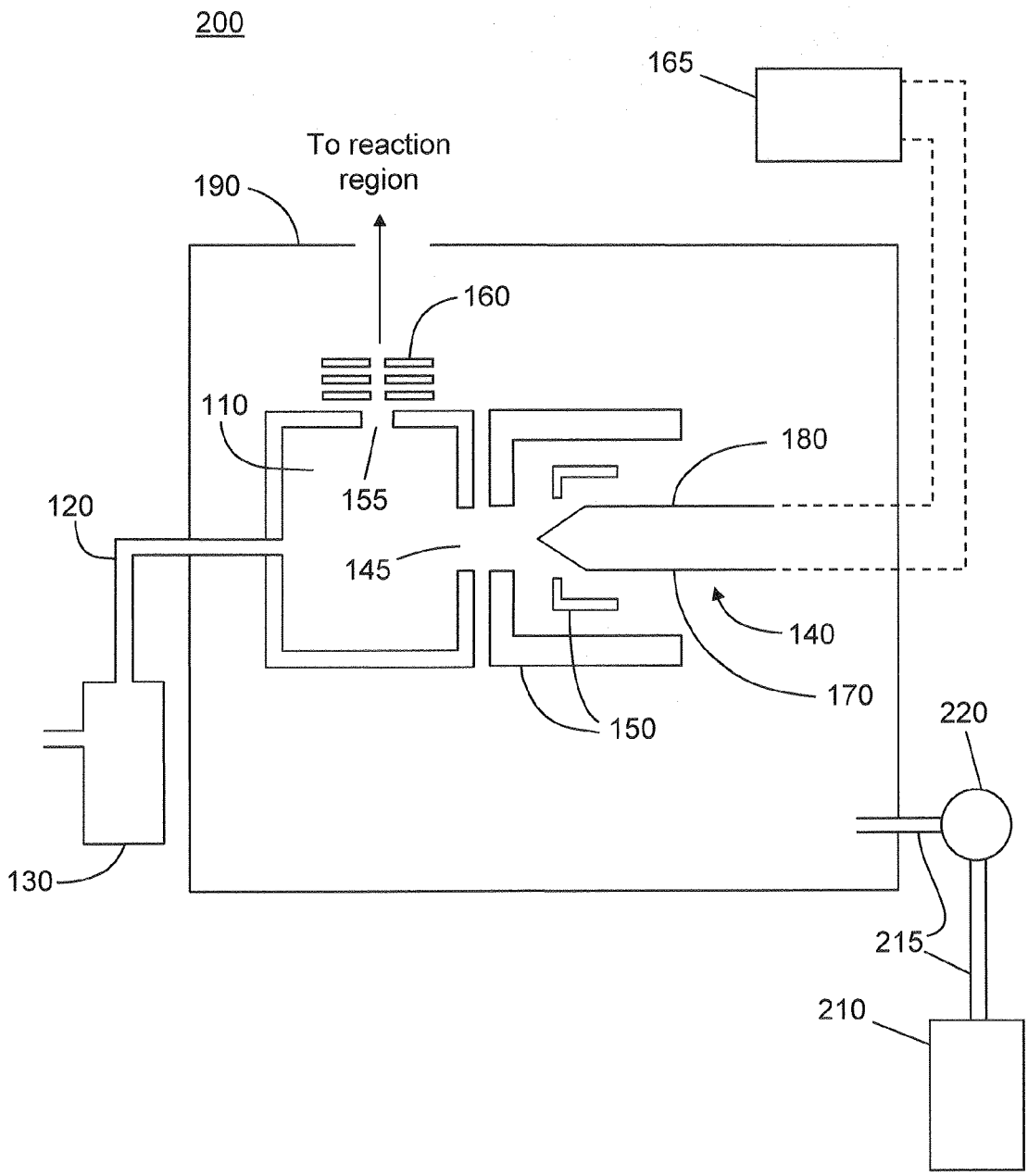
FIG. 5B is a schematic diagram of an ETD ion source in accordance with the present teachings.

FIG. 5B provides an example of an ETD reagent ion source apparatus 200. In the ETD ion source apparatus 200, the filament 140 (comprising legs 170 and 180), an ionization volume 110, electrodes 150, aperture 145, and lenses 160 perform similar functions to comparably numbered components in FIG. 1B. This set of components is maintained within a vacuum chamber 190 that is fluidically coupled to a vacuum system (not shown) that is able to maintain the interior pressure of the vacuum chamber 190 at approximately $5\times10^{-6}$ Torr to $1\times10^{-3}$ Torr. Also the reagent vial 130, conduit 120 and DC power supply 165 perform functions similar to the functions performed by the comparably numbered components of FIG. 1B and may reside outside of the vacuum chamber 190 with appropriate feed-through components to permit the conduit 120 and the electrical leads from the power supply 165 to the filament 140 to pass into the vacuum chamber 190. The apparatus 200 further comprises an oxygen source 210, a variable metering valve or variable leak rate valve 220 as shown in FIG. 5A and an auxiliary gas conduit 215.

The controlled flow of oxidizing gas from the oxygen source 210 (FIGS. 5A-5B) should be such that the oxygen partial pressure within the vacuum chamber 190 is maintained at a value of within a range of approximately $1\times10^{-6}$ to $1\times10^{-5}$ Torr. The inventors have discovered that, with the provision of a small partial pressure of oxygen gas within this range to an ETD reagent ion source chamber, formation of a carbonaceous mass on the filament is inhibited, thereby prolonging useful filament lifetime. The amount of oxygen required to inhibit tumor formation is dependent on the amount (partial pressure) of ETD reagent or other carbon containing compound(s) in the vicinity of the filament. In a set of experiments, the inventors determined that, with a first delivery rate of fluoranthene, an added partial pressure of $3.5\times10^{-6}$ Torr of oxygen was required to prevent carbonaceous tumor growth. However, at an added $O_2$ partial pressure of $2.0\times10^{-6}$ Torr, a tumor grew at approximately the same rate as with no added oxygen. When the delivery rate of fluoranthene was approximately doubled—thereby doubling the partial pressure of reagent molecules in the vicinity of the filament, a tumor grew quickly with the same $3.5\times10^{-6}$ Torr partial pressure of added oxygen. However, with $7.0\times10^{-6}$ Torr of added oxygen at the doubled partial pressure of fluoranthene reagent molecules, no tumor growth was observed. The actual pressure required to suppress tumor growth may generally be system-dependent. For example, the partial pressures of oxygen or an oxidizing gas will depend on the design of the source, filament and vacuum system as well as the delivery rate and type of carbon bearing material (ETD reagent gas type or other gas type, sample etc.) delivered to the source.

Figure 5C:
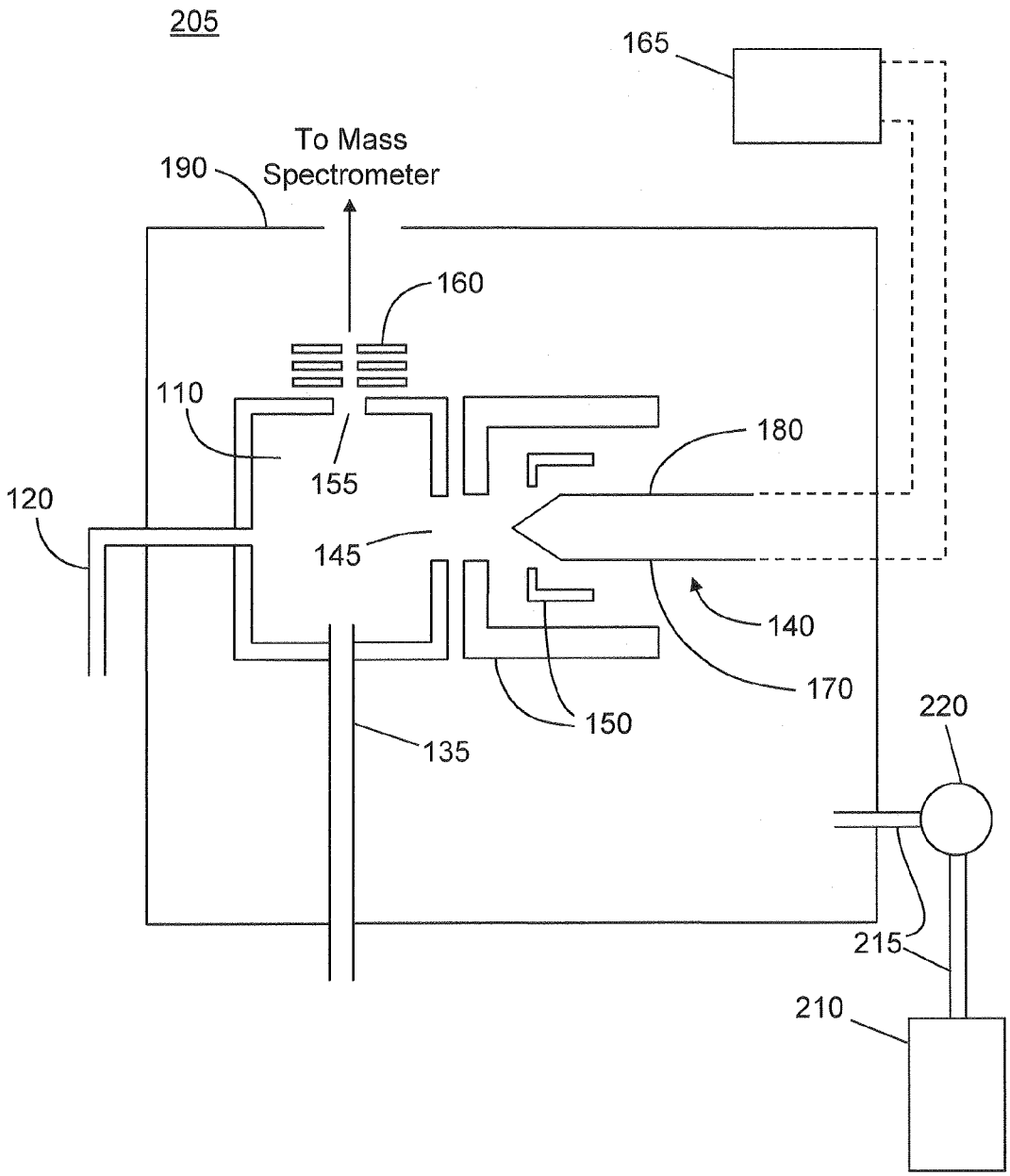
FIG. 5C is a schematic diagram of a CI ion source in accordance with the present teachings.
Figure 5D:
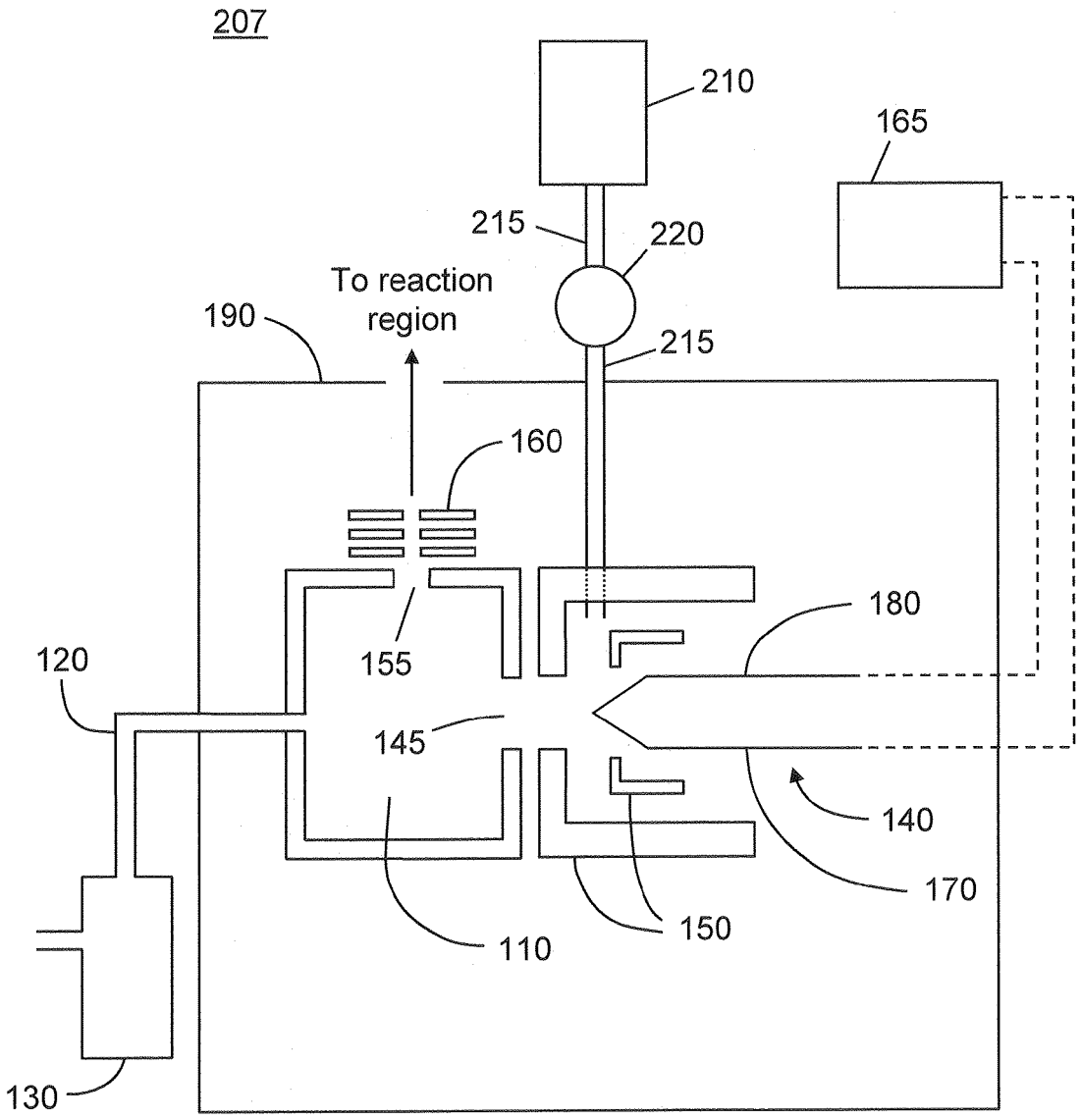
FIG. 5D is a schematic diagram of a second ETD ion source in accordance with the present teachings.

The CI ion source apparatus 205 illustrated in FIG. 5C is similar to the apparatus 200 shown in FIG. 5B but includes an output end portion of a chromatograph column 135 such as a gas chromatograph (GC) column that projects into the vacuum chamber 190 (as in FIG. 1C). In this apparatus, the conduit 120 provides a background gas into the ionization volume 110. The ion source apparatus 207 illustrated in FIG. 5D is another example of an ETD source apparatus—as is the ion source 200 illustrated in FIG. 5B—but differs from the ion source 200 in that, in the ion source 207, the auxiliary gas conduit 215 delivers an oxygen-containing gas from the oxygen source 210 directly to the vicinity of the filament 140. As illustrated in FIG. 5D, the oxygen-containing gas is delivered to a filament enclosure volume 155 defined between the filament 140 and the outermost of the electrodes 150. This configuration enables a user to provide only a flow of the oxygen-containing gas which is just sufficient to inhibit tumor formation. The auxiliary conduit 215 may be configured so as to deliver a flow of the oxygen-containing gas that is counter to the flow direction of electrons into the ionization volume 110, thereby minimizing possible side reactions within the ionization volume. The oxygen-containing gas delivery system of any of the ion source apparatuses (FIGS. 5A-5C) could be modified similarly.

In various alternative embodiments (not illustrated), the oxygen-containing gas could be introduced into the conduit 120 such that the oxygen-containing gas is delivered at a controlled flow rate directly into the ionization volume 110 together with the reagent and/or background gas. However, such a configuration may not be optimal for all situations. This is because, as a result of the restricted conductance through aperture 145, delivering the oxygen-containing gas directly into the ionization volume 110 in this fashion could lead to a several-fold higher oxygen partial pressure within the ionization volume 110 than in the filament enclosure volume 155. This level of oxygen-containing gas may lead to undesirable side reactions in some situations. For example, if the ion source is an ETD source, then if the ionization volume contains a high level of molecular oxygen, which has a high electron affinity, the introduced oxygen may compete with fluoranthene (or other ion-ion reagent gas) neutrals for thermal-energy electrons, thus interfering with the production of reagent ions. Introducing the oxygen directly into the vacuum chamber 190 (FIGS. 5A-5B) or into the filament enclosure volume 155 (FIG. 5C and variations thereof) keeps the oxygen partial pressure in the ionization volume 110 at or below the oxygen partial pressure in the vicinity of the filament.

The amount of oxygen required to prevent tumor growth appears to be linearly related to the amount of reagent or other carbon containing material. It is reasonable to assume that at least one oxygen atom is required for every carbon atom, as this would form CO. The oxygen may be provided by a single oxygen-containing gas component or, alternatively, by a mixture of gas components that together provide a requisite partial pressure of oxygen in the vicinity of a filament. The delivery rate of oxygen or other oxygen-providing gas (such as a nitrogen oxide) or gases may be controlled by the variable metering valve or variable leak rate valve 220. In various alternative embodiments, one of ordinary skill in the art can envisage many alternative forms of restrictive fluidic coupling for metering the flow rate of oxygen providing gas. For example, the metering valve or variable leak rate valve 220 could be replaced by a restrictive fluidic coupling comprising an adjustable pressure regulator (wherein, for instance, the oxygen source 210 is a pressurized gas cylinder) followed, along the gas flow path, by a gas flow restrictor. The gas flow restrictor may comprise a capillary restrictor—e.g., a capillary having a chosen narrow bore along all or a part of its length—or, alternatively, a frit or an equivalent gas flow restrictor. In another example, the variable leak rate valve 220 could replaced by a restrictive fluidic coupling comprising a fixed pressure regulator followed, along the gas flow path, by a capillary restrictor, frit or other equivalent gas flow restrictor. In yet another example, the variable leak rate valve 220 could comprise a mass flow controller, comprising input and output ports, a mass flow sensor and a control valve. Such mass flow controllers are readily commercially available. In various embodiments, the oxygen source 210 could comprise ambient air in which case a separate gas container and pressure regulator may not be required. The variable leak rate valve 220 could then be replaced by a restrictive fluidic coupling comprising just a capillary restrictor, frit or other equivalent gas flow restrictor.

The kinetics of incorporation carbon or carbonaceous material derived from a particular organic (carbon containing) gas with a particular filament may be difficult to predict. Further, the kinetics of reaction between carbon or carbonaceous material in or on a particular metal filament and a particular oxidizing gas may also be difficult to predict. For example, Becker et al. (*J Appl Phys,* 32, 1961, pp. 411-423) reacted a tungsten (W) ribbon—either carbon-free or precarbonized—with flowing oxygen gas and measured consumption or evolution of various gas species. From these measurements, they computed absolute rates at which $O_2$ was converted to $WO_3$, CO, $CO_2$, and O or evaporated as $O_2$ at various temperatures. Their studies indicated that, when the metal is unsaturated with carbon, the rate of CO generation is limited, at lower temperatures, by the rate at which dissolved C diffuses to the surface of the W ribbon. In such situations, the amount of carbon removed from the ribbon is independent of the partial pressure of oxygen when the rate of oxygen that is delivered to the surface is at least 10 to 30 times the temperature-dependent rate that carbon diffuses to the surface. If the oxygen pressure is not high enough, carbon atoms can accumulate on the surface and will diffuse back into the tungsten. However, at higher temperatures or with carbon saturation or near saturation of the W ribbon, the rate of CO generation becomes limited by the rate at which $O_2$ molecules strike the hot W.

The filament systems considered in relation to the instant invention are more complex than those studied by Becker et al. as they include the likelihood of the simultaneous operation of the processes of: (a) high-temperature decomposition of organic gases in the immediate vicinity of the high-temperature emission region of a filament, (b) dissolution into the filament of carbon released by the decomposition, (c) electromigration or diffusion of the dissolved carbon within the metal filament, (d) formation of CO and $CO_2$ gases by reaction of dissolved carbon with the oxygen-containing gas and (e) nucleation and exsolution of one or more carbon-bearing phases as the carbon solubility approaches saturation with decreasing temperature along the filament. Because the system will generally not be in kinetic equilibrium, it is considered that whether or not tumors form is related, in complex fashion, to the rates of all of the above processes and possibly others. As a result, it is expected that the necessary partial pressure required to suppress tumor growth will depend on the source and filament mechanical design (geometry), the filament material, the operating current (AC or DC and amplitude), the pumping speed for the pump on the source chamber, the amount of tumor inducing reagent or sample material delivered to the source as well as other factors.

Further, it should also be noted that not all carbon containing compounds cause carbonaceous tumors on rhenium and tungsten filaments under the normal operating conditions of filament-based sources. For example, methane has never been found to create a tumor on such filaments. By contrast, Becker et al. noted that a tungsten filament can become heavily carbonized by heating it in hydrocarbon $C_2H_2$ vapors. Without being limited by any particular hypothesis, the inventors speculate that very volatile compounds may not reside on the filament long enough for the carbon to dissolve in the wire.

There is a practical upper limit to the oxygen partial pressure to which a filament may safely be exposed during operation. It is well known that exposure of operating filaments to higher partial pressures of oxygen has the potential to cause accelerated evaporation of filament material (ultimately leading to filament failure) and formation of the anion $ReO_3^-$, which is often observable in the negative ion mass spectra of the ions produced by the source. Thus, the oxygen partial pressure must be maintained lower than a pressure at which an appreciable rate of filament evaporation or formation of $ReO_3^-$ occurs. Further there is some evidence that exposure to elevated levels of oxygen may promote bending or warping of filaments. In a commercial ETD reagent ion source (Thermo Fisher Scientific), no evidence of either filament degradation by evaporation formation of $ReO_3^-$ (masses of 233 and 235 Da) was observed in the present experiments using a controlled partial pressure of approximately $1\times10^{-6}$ Torr. Also, by adding the oxygen gas to the reagent ion source chamber, the reagent anion signal, which originates from the ion volume, was unaffected. While the above discussion was specific to oxygen, it would be reasonable that there would also be practical limits to the partial pressures of other oxidizing gases that would be suitable for suppression of the growth of carbonaceous masses in filaments. These limits would depend substantially on the oxidizing gas and the filament material and design but other factors could also be involved.

The inventors have discovered that oxygen may be used to remove existing carbonaceous masses assuming they have not grown to a size which compromises the structural integrity of the filament. This allows one to recondition a contaminated filament by heating the filament and introducing oxygen (or an oxygen-providing gas) to the filament during a time when the containing mass spectrometer instrument is not performing analyses. Such conditioning procedures may be performed at regular intervals, such as daily. Performing such conditioning procedures when a mass spectrometer instrument is "offline" may be especially useful if the addition of oxygen is found to interfere with the one or more analyses. For example, oxygen may create competing reactions in the ion source which are undesirable.

In summary, addition of an oxygen-containing gas in the vicinity of the filament is shown to prevent formation of a carbonaceous mass on metal filaments used in ion sources, thereby extending the useful operational lifetimes of such filaments, without sacrificing source sensitivity. The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention. All patent application disclosures, patent application publications or other publications are hereby explicitly incorporated by reference herein as if fully set forth herein. In any instances in which such incorporated material is in conflict with the present disclosure, the present disclosure shall control.

What is claimed is:

1. A method of operating an ion source for a mass spectrometer comprising:

providing a refractory metal thermionic filament positioned within a vacuum chamber, wherein the filament is fabricated from rhenium or a rhenium alloy;

passing a current through the filament to generate a stream of electrons wherein the filament is operated at a temperature in excess of 1200 degrees Kelvin;

introducing a carbonaceous gas including one of a reagent gas or a sample gas into the vacuum chamber, wherein molecules in the gas interact with the stream of electrons or with ionized background gases to form ions, wherein a portion of the gas comes into contact with surfaces of the filament such that carbon from the carbonaceous gas is dissolved in the filament, resulting in the subsequent formation of at least one carbonaceous growth on the filament; and, introducing an oxygen-containing gas devoid of fluorine gas or nitrogen trifluoride into the vacuum chamber, wherein the oxygen-containing gas removes all or part of the carbonaceous growth or inhibits its formation.

2. A method as claimed in claim 1 wherein the oxygen-containing gas comprises ambient air.

3. A method as claimed in claim 1 wherein one or more components of a sample provided to the mass spectrometer comprise the gaseous carbon-containing material.

4. A method as claimed in claim 1 wherein the pressure of the reagent gas is at least $1\times10^{-7}$ Torr in the vacuum chamber.

5. A method as claimed in claim 1 wherein a gas chromatograph is coupled to the ion source providing sample gas molecules as the carbonaceous gas.

6. A method as claimed in claim 1 wherein the partial pressure of the oxygen-providing gas or gases maintained within the vacuum chamber is at least $1\times10^{-6}$ Torr.

7. A method as claimed in claim 1 wherein the partial pressure of the oxygen-providing gas or gases within the vacuum chamber is insufficient to promote significant evaporation of the rhenium from the filament.

8. A method as claimed in claim 1 wherein the reagent gas comprises a polycyclic aromatic hydrocarbon.

9. A method as claimed in claim 1 wherein the reagent gas comprises at least one compound selected from the group consisting of naphthalene, fluorine, phenanthrene, pyrene, fluoranthene, chrysene, triphenylene, perylene, acridine, 2,2' dipyridyl, 2,2' biquinoline, 9-anthracenecarbonitrile, dibenzothiophene, 1,10'-phenanthroline, 9' anthracenecarbonitrile, and anthraquinone.

10. A method as claimed in claim 1 wherein the reagent gas comprises at least one compound chosen from the group consisting of azulene, homoazulene, acenaphthylene, homodimers of azulene, homodimers of homoazulene, and homodimers of acenaphthylene.

11. A method as claimed in claim 1 wherein the reagent gas comprises at least one compound chosen from the group consisting of a heterodimer comprising one azulene unit and one homoazulene unit, a heterodimer comprising one azulene unit and one acenaphthylene unit and a heterodimer comprising one homoazulene unit and one acenaphthylene unit.

12. A method as claimed in claim 1 wherein the reagent gas comprises an aliphatic compound with an electron affinity between 0.3 and 0.8 electron-volts.

13. A method as claimed in claim 12 wherein the aliphatic compound is 1-3-5-7-cyclooctatetraene.

14. A method as claimed in claim 1 wherein the reagent gas comprises at least one compound chosen from the group consisting of benzoic acid, perfluoro-1,3-dimethylcyclohexane, and perfluorotributylamine.

15. A method as claimed in claim 1 wherein the reagent gas comprises an unsaturated organic compound having a Franck-Condon factor between 0.1 and 1.0 and a positive electron affinity value between 0.1 and 200 kJ/mol.

16. A method as claimed in claim 1 wherein the reagent gas comprises at least one compound chosen from the group consisting of nitrosobenzene; nitrobenzene; 1,4 dicyanobenzene; 1,3 dicyanobenzene; 5-cyano 1,2,4-triazole; amitrole 2-aminopyridine; 2-pyridine carbonitrile; 3-pyridine carbonitrile; 3-chlorobenzonitrile; 4-chlorobenzonitrile; 3-pyridinecarbonitrile; 4-pyridinecarbonitrile; 1,2-dicyanoethylene and 1,2-dicyanoacetylene.

17. A method as claimed in claim 1 wherein the oxygen-containing gas or gases comprises a pressurized gas mixture of x percent oxygen ($O_2$) and (100−x) percent of another gas or of a mixture of gases, wherein $0.1\leq x\leq 25$.

18. A method as claimed in claim 1 wherein the oxygen-providing gas or gases comprises zero-grade air.

19. A method as claimed in claim 1 wherein the oxygen-providing gas or gases comprises nitrous oxide ($N_2O$).

20. A method as claimed in claim 1 wherein the oxygen-providing gas or gases comprises water vapor ($H_2O$).

21. A method as claimed in claim 1 wherein the electrical current source is an alternating current (AC) current source.

22. A method as claimed in claim 1 wherein the electrical current source is a direct current (DC) current source.

23. A method as recited in claim 1, wherein the ion source comprises an electron ionization (EI) source and wherein a sample provided to the mass spectrometer comprises the gaseous carbon-containing material.

24. A method as recited in claim 1, further comprising:

providing an ionization volume fluidically coupled to the vacuum chamber; and providing a conduit operable to provide a reagent gas into the ionization volume so as to maintain a partial pressure of the reagent gas within the ionization volume of at least $1\times10^{-7}$ Torr, wherein the ion source comprises a chemical ionization (CI) source and wherein the reagent gas comprises the gaseous carbon-containing material.

25. A method as recited in claim 1, wherein the controlled flow of the gas or gases from the source of oxygen-providing gas or gases is provided into the vacuum chamber so as to maintain the partial pressure of the oxygen-providing gas or gases within the vacuum chamber at a level that is insufficient to promote significant evaporation of the rhenium from the filament.

26. A method as recited in claim 1, further comprising:

providing an ionization volume fluidically coupled to the vacuum chamber; and, providing a conduit operable to provide a reagent gas into the ionization volume so as to maintain a partial pressure of the reagent gas within the ionization volume of at least $1\times10^{-7}$ Torr, wherein the ion source comprises a chemical ionization (Cl) source and wherein the reagent gas comprises the gaseous carbon-containing material.

* * * * *